US005445556A

United States Patent [19]

Miura

[11] Patent Number: 5,445,556

[45] Date of Patent: Aug. 29, 1995

[54] VIBRATION MOTOR AND METHOD OF MACHINING A VIBRATION MEMBER THEREOF

[75] Inventor: Mitsuru Miura, Utsunomiya, Japan

[73] Assignee: Canon Kabushiki Kaisha, Tokyo, Japan

[21] Appl. No.: 136,103

[22] Filed: Oct. 14, 1993

Related U.S. Application Data

[63] Continuation of Ser. No. 979,473, Nov. 20, 1992, abandoned, which is a continuation of Ser. No. 648,058, Jan. 30, 1991, abandoned.

[30] Foreign Application Priority Data

Jan. 31, 1990 [JP] Japan ..... 2-20711

[51] Int. Cl.[6] ..... B24B 19/02

[52] U.S. Cl. ..... 451/28; 451/47

[58] Field of Search ..... 51/33 R, 35, 37, 53, 51/72 L, 105.66, 165.77, 281 R, 287, 288, 326, 327, 100 R, DIG 1; 310/323, 328; 83/54, 875

[56] References Cited

U.S. PATENT DOCUMENTS

| | | | |
|---|---|---|---|
| 2,552,164 | 5/1951 | Foss | 51/33 R |
| 3,691,707 | 9/1972 | Von Arx et al. | 51/281 X |
| 3,719,009 | 3/1973 | Thompson | 51/319 |
| 3,800,661 | 4/1974 | Omonishi | 83/875 X |
| 3,948,124 | 4/1976 | Dombroski et al. | 83/54 X |
| 4,279,102 | 7/1981 | Hennenfeny et al. | 51/281 X |
| 4,524,544 | 6/1985 | Habib | 51/288 |
| 4,763,148 | 8/1988 | Tsukimoto et al. . | |
| 4,793,101 | 12/1988 | Dloumy et al. | 51/327 X |

*Primary Examiner*—Jack W. Lavinder

*Attorney, Agent, or Firm*—Fitzpatrick, Cella, Harper & Scinto

[57] ABSTRACT

A vibration member of a vibration motor and a method of machining the vibration member to form grooves therein. The bottom of each groove has the shape of an arc of a circle whose center is located on the side of a contact member, e.g., a rotor, so that burrs formed when the vibration member is machined are curved in a direction away from the base portion of the vibration member, i.e., toward the contact member side, and so that the burrs can be easily removed by barrel finishing.

17 Claims, 4 Drawing Sheets

VIBRATION MOTOR AND METHOD OF MACHINING A VIBRATION MEMBER THEREOF

This application is a continuation, of application Ser. No. 07/979,473 filed Nov. 20, 1992, now abandoned, which is a continuation of 07/648,058 filed Jan. 30, 1991, now abandoned.

BACKGROUND OF THE INVENTION

1. Field of the Invention

This invention relates to vibration motors for use in cameras, office machines, semiconductor device manufacture systems and the like and, more particularly, to a method of machining grooves into a vibration member of a vibration motor.

2. Description of the Related Art

Many vibration motors have already been proposed in which a piezoelectric element is attached to an elastic member to form a vibration member and electrical signals differing in phase are applied to the piezoelectric element to produce vibration waves, such as a traveling vibration wave, in the elastic member so that a member in contact with the elastic member, for example, a rotor, moves relatively by the vibration waves. Such vibration motors have been put to practical use for cameras and video apparatus because they have a comparatively large torque when rotated at a low speed.

In many of the vibration motors proposed, it has been proposed to form a plurality of grooves in the elastic member for magnifying the amplitude of the vibration of the elastic member. Each of these grooves extends in a direction perpendicular to the direction in which the vibration waves propagate. Such grooves are depicted at 1A in FIG. 4 for the case in which the elastic member is a circular member and the vibration waves induced therein travel along the circumference of the elastic member.

As shown in FIG. 5, ordinarily, grooves 1A are formed by moving a metal saw 5 in the direction of the arrow 5A, that is, a direction perpendicular to the direction of propagation of the vibration wave, while the elastic member is held fixed. A bottom 1C of each groove 1A is thereby formed so as to extend linearly.

In this conventional machining method, a burr 1D is undesirably formed at each groove, as shown in detail in FIG. 5.

This burr is hard because of work hardening, and it is necessary to scratch the burr off each groove by using a stainless steel brush or the like. Burr removal is particularly hindered because each burr is curled to a base 1E of the elastic member 1 making it difficult for the stainless steel brush to "bite" at the burr.

In the ordinary vibration motor, about 100 grooves 1A are formed in the elastic member 1. The time required for this scratching is about 100 seconds with respect to one elastic member, which greatly influences the manufacture cost.

SUMMARY OF THE INVENTION

It is an object of the present invention to provide a method of machining a vibration member of a vibration motor whereby burrs formed on the vibration member by such machining can be easily removed by barrel finishing or the like.

It is another object of the present invention to provide a vibration member machining method which reduces the machining cost.

It is still another object of the present invention to provide a low-cost vibration motor or apparatus.

In one aspect of the present invention, these objects are achieved by machining grooves so that the bottom of the groove has the shape of an arc of a circle (circular arc or arc line) whose center is located on the side of a contact member, e.g., a rotor, so that burrs formed when the vibration member is machined are curved in a direction away from the base 1E, i.e., toward the contact member side, and that the burrs can be easily removed by barrel finishing.

Other objects and features of the present invention will become apparent from the following detailed description of the invention.

DESCRIPTION OF THE PREFERRED EMBODIMENT

Figure 1:
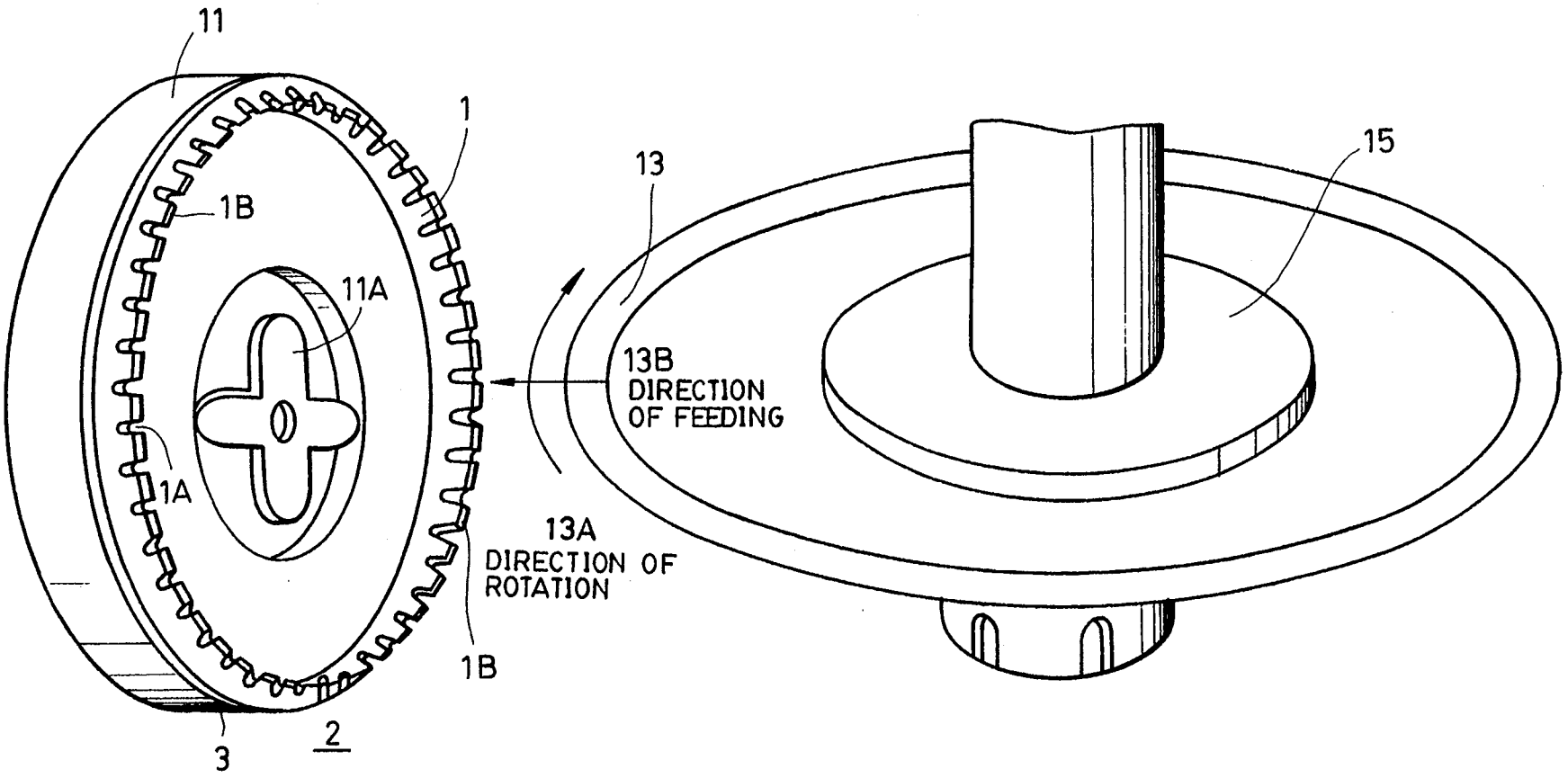
FIG. 1 is a perspective view of a vibration member of a vibration motor, i.e., a machined object and a grinder in accordance with the present invention, showing the positional relationship therebetween.

FIG. 1, which is a perspective view of the portion of a vibration motor to which the present invention is applied, illustrates the states and portions of an elastic element 1 of the vibration motor and a grinder 13 before the elastic element 1 is machined. In this embodiment of the invention, the elastic element is generally circular and a vibration wave induced in it travels along its circumference.

Figure 4:
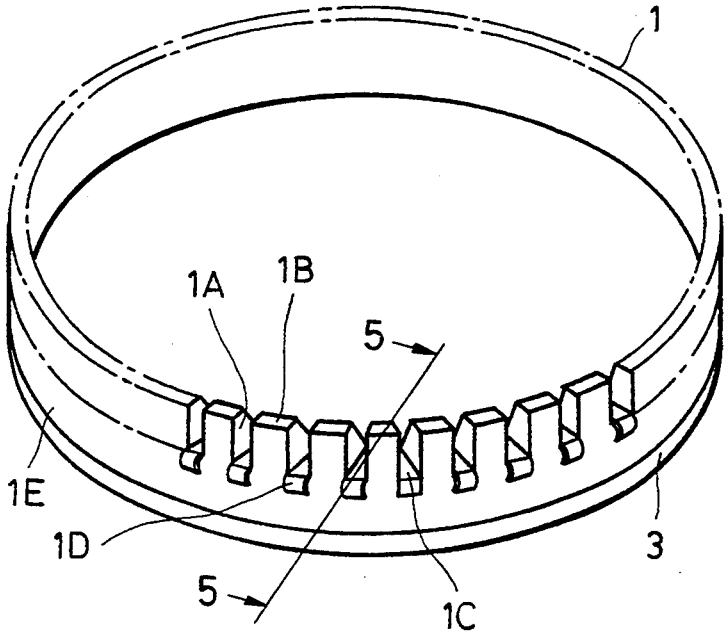
FIG. 4 PRIOR ART
FIG. 4 is a perspective view of vibration member machined by the conventional method, showing the machined shape and formation of burrs.

The elastic element 1 shown in FIG. 1 is formed of a SUS (stainless steel, JIS) material and has a contact surface 1B. A vibration member 2 is composed of the elastic element 1 and a piezoelectric element 3 which is a well-known kind of electro-mechanical energy conversion element and which produces the traveling vibration wave. A fastening member 11A is used to detachably attach the vibration member 2 to a holding jig 11 used to work the elastic element 1 to form grooves 1A. In this case, the grinder 13 is a circular grinder and is set perpendicularly or generally perpendicularly to the direction in which traveling vibration waves propagate. The grinder 13 is rotated in a direction 13A shown in FIG. 1 by a power source (not shown), and is moved so as to advance or retreat in the generally perpendicular direction 13B thereby to form the grooves 1A. The grinder 13 is supported by a grinder holder 15. Portions or components corresponding to those of the conventional device shown in FIG. 4 are indicated by the same reference characters, and the description for them will not be repeated. Peripheral apparatuses for supplying electrical signals to the piezoelectric element 3 of this motor, the vibration absorbing member and other components of this motor may be the same as, for example, those disclosed in U.S. Pat. No. 4,763,148 and therefore will not be described in this specification.

The grinder 13 is rotated in the predetermined direction 13A and is moved in the direction 13B to form one of the grooves 1A. The grinder 13 is in the form of a ring and its grinding surface has a locus such as that indicated by a dot-dash line in FIG. 2 (circular arc cutting locus). The bottom of the groove 1A formed thereby therefore has the shape of an arc, such as that indicated by 1CC in FIG. 3, of a circle whose center is located on the side of a well-known ring rotor 20 which, when the vibration motor is assembled, is brought into frictional contact with the contact portion 1B. Because the grinding surface has the indicated locus, a burr 1DD (FIG. 3) formed by machining is curved in a direction away from the base portion 1E, i.e., toward the contact portion, and is in a raised, outwardly extending state. The burrs formed by the method of the present invention can therefore be removed by, for example, barrel finishing or the like. Consequently, the working time is reduced to 1/10 of that in the case of the conventional method wherein the burrs are respectively removed from the grooves, and the elastic element manufacture cost is also reduced to about 1/10.

In the above-described embodiment, the grinder 13 having a large diameter (relative to the width of base portion 1E) is moved in the feeding direction 13B to work the elastic element 1 so that the groove 1A has a circular-arc bottom. Alternatively, a small-diameter grinder may be used while the center or the edge of the grinder is being moved along a circular arc concentric with the circular arc indicated by the dot-dash line C in FIG. 2 so that each groove 1A has a circular-arc or generally arched bottom. In this case also, burrs 1DD are formed in the same way as the burr shown in FIG. 3, and the same effect can therefore be obtained.

According to the working method of the present invention, as described above, burrs rise in the direction opposite to the base portion of the elastic element 1 so as to be removed very easily. It is thereby possible to reduce the manufacture cost of the vibration motor.

What is claimed is:

1. A method of machining a groove into a vibration member of a vibration motor, the vibration member having a contact portion into which the groove is machined and against which a contact member is contactable and relatively movable by a vibration wave produced in the vibration member, said method comprising the step of machining the vibration member so that the bottom of the groove of the vibration member, in a direction perpendicular to a direction of the vibration wave, has a curvature with a center of radius located on a contact side of said contact portion.

2. A method according to claim 1, wherein said machining step includes the step of forming a burr that extends outwardly away from the vibration member in a direction substantially the same as that of a circular-arc cutting locus of a cutting member used to machine the groove.

3. A method according to claim 2, further comprising the step of removing the burr by barrel finishing.

4. A method of machining a vibration member of a vibration motor in which a contact member contactable to a contact portion of the vibration member is driven by a traveling vibration wave, said vibration member having an axis of rotation and a depth in a direction parallel to said axis, said method comprising the single step of moving a cutting member along a line in a predetermined direction of the depth of the vibration member to cut a groove in the contact portion.

5. A method according to claim 4, further comprising the step of rotating the cutting member while performing said moving step.

6. A method according to claim 5, wherein the cutting member has a ring shape.

7. A method according to claim 4, wherein said moving step includes the step of forming a burr that extends outwardly away from the vibration member.

8. A method of machining a vibration member of a vibration motor in which a contact member contactable to a contact portion of the vibration member is driven by a traveling vibration wave, said vibration member having a depth, said method comprising the step of moving a rotating cutting member along a line in a direction of the depth of the vibration member to cut a groove in the contact portion, wherein a center of the rotating cutting member further is moved along an arc-line, whereby a cutting surface of the rotating cutting member moves along a concentric arc-line to form an arched bottom surface of the groove.

9. A method of machining a vibration member of a vibration wave motor in which a contact member is contactable to a contact portion of the vibration member and is drivable by a traveling vibration wave, said method comprising the step of cutting a groove into the contact portion by moving a cutting member along an arc-line having a center located on a contact side of the contact portion.

10. A method according to claim 9, wherein said cutting step includes the step of rotating the cutting member.

11. A method according to claim 9, wherein said cutting step includes the step of forming a burr that extends outwardly away from the vibration member.

12. A method according to claim 11, further comprising the step of removing the burr by barrel finishing.

13. A method of machining a groove into a vibration member of a vibration motor, the vibration member having a contact portion into which the groove is machined and against which a contact member is contactable and relatively movable by a vibration wave produced in the vibration member, said method comprising the step of machining the vibration member so that an end portion of the bottom of the groove of the vibration member, in a direction perpendicular to a direction of the vibration wave, has a curvature with a center of radius is located on a contact side of said contact portion.

14. A method for machining a vibration member of a vibration motor in which a contact member contactable to a contact portion of the vibration member is driven by a traveling vibration wave, said vibration member having a depth, said method comprising the step of moving a rotating cutting member along a line in a direction of the depth of the vibration member to cut a groove in the contact portion, wherein a center of the rotating cutting member further is moved along a line of locus points, whereby a cutting surface of the rotating cutting member moves along a parallel line of locus points to form an arched bottom surface portion of the groove.

15. A method according to claim 14, including the step of forming a burr that extends outwardly away from the vibration member in a direction substantially the same as that of a circular arc cutting locus of the cutting member.

16. A method according to claim 14, wherein said arched bottom surface portion is formed at least at an exit portion of said groove.

17. A method of machining a groove into a vibration member of a vibration motor, the vibration member having a contact portion into which the groove is machined and against which a contact member is contactable and relatively movable by a vibration wave produced in the vibration member, said method comprising the step of machining the vibration member so that a thickness of the vibration member at an end portion of a bottom surface of the groove is greater than a thickness of the vibration member at a center portion of the bottom surface of the groove.

* * * * *

UNITED STATES PATENT AND TRADEMARK OFFICE

CERTIFICATE OF CORRECTION

PATENT NO. : 5,445,556

DATED : August 29, 1995

INVENTOR(S) : Mitsuru Miura

It is certified that error appears in the above-indentified patent and that said Letters Patent is hereby corrected as shown below:

On the title page:

AT [56] U.S. PATENT DOCUMENTS

"Dombroski et al." should read --Dombrowski et al.--;
"Hennenfeny et al." should read --Hennenfent et al.--; and
"Dloumy et al." should read --Dlouhy et al.--

Column 2

Figure 2:
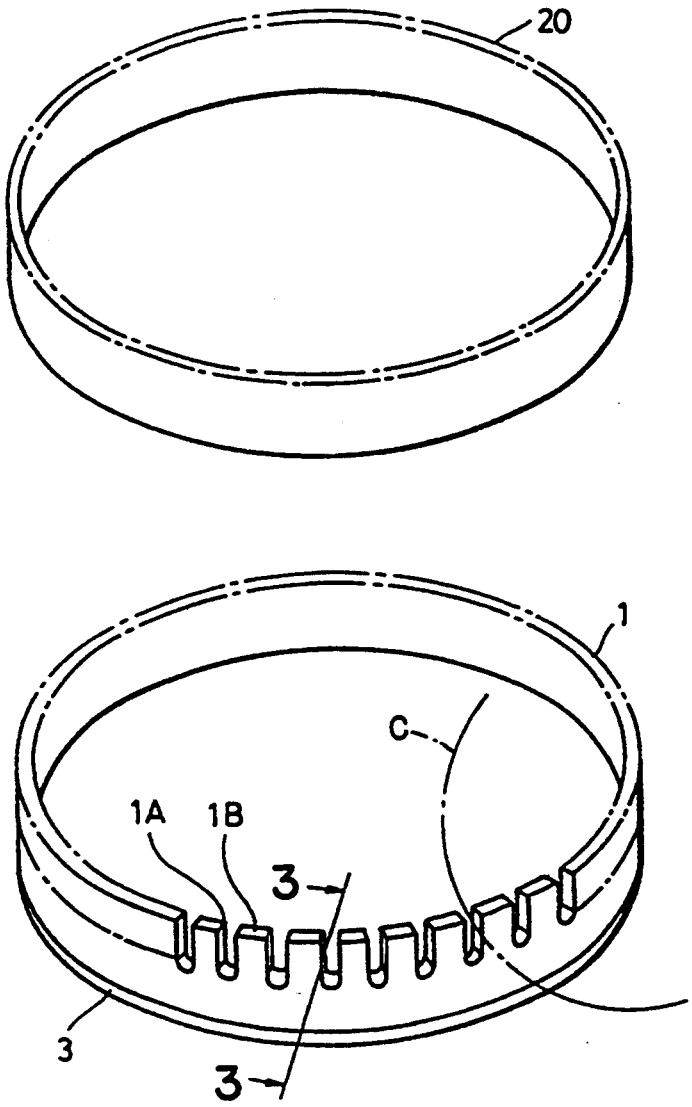
FIG. 2 is a perspective view of the vibration member having grooves formed by machining.
Figure 3:
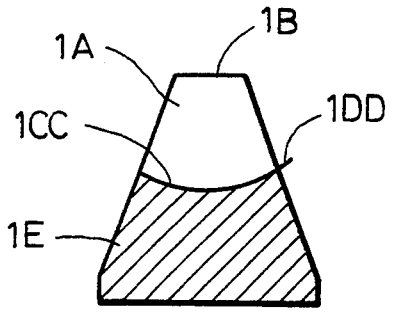
FIG. 3 is a cross-sectional view taken along the line 3—3 of FIG. 2.
Figure 5:
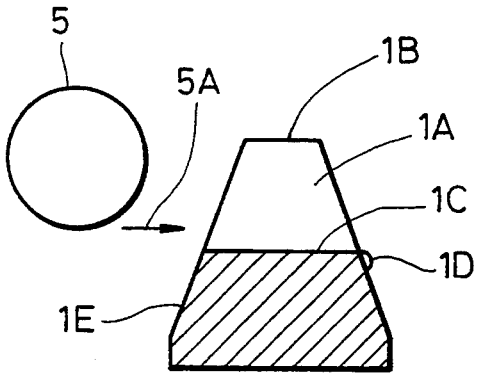
FIG. 5 PRIOR ART
FIG. 5 is a cross-sectional view taken along the line 5—5 of FIG. 4.

Line 24, "FIG. 2," should read --FIG. 2;--; and
Line 25, "vibration" should read --a vibration--.

Column 4

Line 48, "is" should be deleted.

Signed and Sealed this

Nineteenth Day of December, 1995

Bruce Lehman

*Attest:*

BRUCE LEHMAN

*Attesting Officer*

*Commissioner of Patents and Trademarks*